US006041890A

United States Patent [19]

Wolf et al.

[11] Patent Number: 6,041,890

[45] Date of Patent: Mar. 28, 2000

[54] EXHAUST GAS MUFFLER FOR THE COMBUSTION ENGINE OF A PORTABLE WORKING TOOL

[75] Inventors: Günter Wolf, Oppenweiler; Johannes Menzel, Stuttgart, both of Germany

[73] Assignee: Andreas Stihl AG & Co., Germany

[21] Appl. No.: 09/280,793

[22] Filed: Mar. 26, 1999

[30] Foreign Application Priority Data

Mar. 26, 1998 [DE] Germany ..... 298 05 455 U

[51] Int. Cl.[7] ..... F01N 35/00

[52] U.S. Cl. ..... 181/230; 181/212; 181/239; 181/264; 181/282; 173/DIG. 2; 415/119; 60/317

[58] Field of Search ..... 181/230, 212, 181/240, 238, 239, 264, 282; 173/DIG. 2; 415/119; 60/317

[56] References Cited

U.S. PATENT DOCUMENTS

| | | | |
|---|---|---|---|
| 1,280,386 | 10/1918 | Buehner | 181/230 |
| 1,342,464 | 6/1920 | Sawders et al. | 181/230 |
| 3,650,354 | 3/1972 | Gordon | 181/40 |
| 4,142,607 | 3/1979 | Landwehr et al. | 181/259 |
| 4,231,221 | 11/1980 | Mathner et al. | 60/319 |
| 5,315,075 | 5/1994 | Junginger et al. . | |

*Primary Examiner*—David Martin
*Assistant Examiner*—Edgardo San Martin
*Attorney, Agent, or Firm*—Robert W. Becker & Associates

[57] ABSTRACT

An exhaust gas muffler for an internal combustion engine of a portable, hand-guided working tool has a housing having an exhaust gas inlet, and exhaust gas outlet, and an outlet space, wherein the exhaust gas outlet opens into the outlet space. An outlet opening is provided downstream of the outlet space and has wall elements directing the exhaust gas flow in the exit flow direction. A rebound wall is positioned transverse to the exhaust gas outlet and delimits the outlet space while providing a connecting slot into the outlet opening. The connecting slot is spaced at a distance from the outer wall of the housing that extends substantially parallel to the rebound wall. A first ramp is positioned perpendicularly to the connecting slot and slants upwardly from the rebound wall to the outlet opening. A second ramp extends in a direction of longitudinal extension of the connecting slot from an end of the insertion slot opposite the first ramp to the edge of the first ramp opposite the connecting slot.

15 Claims, 5 Drawing Sheets

EXHAUST GAS MUFFLER FOR THE COMBUSTION ENGINE OF A PORTABLE WORKING TOOL

BACKGROUND OF THE INVENTION

The present invention relates to a exhaust gas muffler for internal combustion engines of a portable, hand-guided working tool comprised of a base housing with an exhaust gas inlet and an exhaust gas outlet whereby the exhaust gas outlet opens into an outlet space having an outlet opening with wall elements for directing the exhaust gas flow in the desired exhaust gas flow direction.

Such an exhaust gas muffler is known from U.S. Pat. No. 5,351,075. The exhaust gas outlet is covered by a hood that defines the outlet space and has wall elements which determine the exit orientation and the exit width of the exiting exhaust gas stream. The hood is a separate part which is to be connected to the base housing.

In practice it was found that, depending on the specific use of the exhaust gas muffler, different exhaust gas flow directions and widths of the exhaust gas stream are required in order not to endanger the user or the environment. Depending on the specific use of such a muffler, a specific hood must be provided for specific purposes that must be connected to the base housing of the exhaust gas muffler.

It is therefore an object of the present invention to embody an exhaust gas muffler of the aforementioned kind such that for improved muffling action and minimal flow resistance the exhaust gas flow direction can be adjusted according to a specific use by constructive means.

SUMMARY OF THE INVENTION

According to the present invention, a rebound wall is provided transverse to the exhaust gas outlet which delimits substantially the outlet space and a connecting slot between the outlet space and the outlet opening. The outlet opening is embodied in an outer wall that is positioned at a spacing parallel to the rebound wall. A first ramp extending transversely to the connecting slot is provided and has an upward slant from the rebound wall to the outlet opening. A second ramp is provided which extends in the longitudinal direction of the connecting slot from its end opposite the first ramp in the direction to the edge of the first ramp opposite the connecting slot.

The connecting slot provided between the rebound wall and the housing allows for flowing of the exhaust gas to flow from the outlet space into an outlet chamber having the outlet opening whereby a large flow cross-section is provided so that the flow resistance for the exhaust gas flow is minimal. The outer wall which extends parallel to the rebound wall covers the connecting slot advantageously in the outward direction so that the exhaust gas is substantially deflected by 180° about the longitudinal edge of the rebound wall. Upon entering the outlet chamber, the exhaust gas flow has a diffuse flow direction and can be redirected by simple measures into an oriented exhaust gas exit flow. For this purpose, a first wall-forming ramp is provided which is positioned transversely to the connecting slot and has an upward slant from the rebound wall to the outlet opening. A second wall-forming ramp which extends in the direction of length as the connecting slot from the area of the connecting slot in the direction to the edge of the first ramp which faces away from the connecting slot. In this manner a cross-section that widens in the direction toward the outlet opening is produced which allows a directed accelerated flow of the exhaust gas out of the outlet opening. The wall-forming first and second ramps guide as constructive means the exhaust gas stream in the desired direction so that for the respective application the desired flow direction can be obtained.

The rebound wall, the outer wall, and the first and second ramps form advantageously the outlet chamber whereby the outer wall covers the connecting slot so that a directed exit of the exhaust gas from the connecting slot into the surroundings is prevented.

The outlet opening provided in the outer wall is positioned at the end of the second ramp facing away from the connecting slot and is delimited also by the ramp surface of the first ramp. The outlet opening can be adjusted in regard to its height and width so that the direction and the width of the exhaust gas flow can be adjusted.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
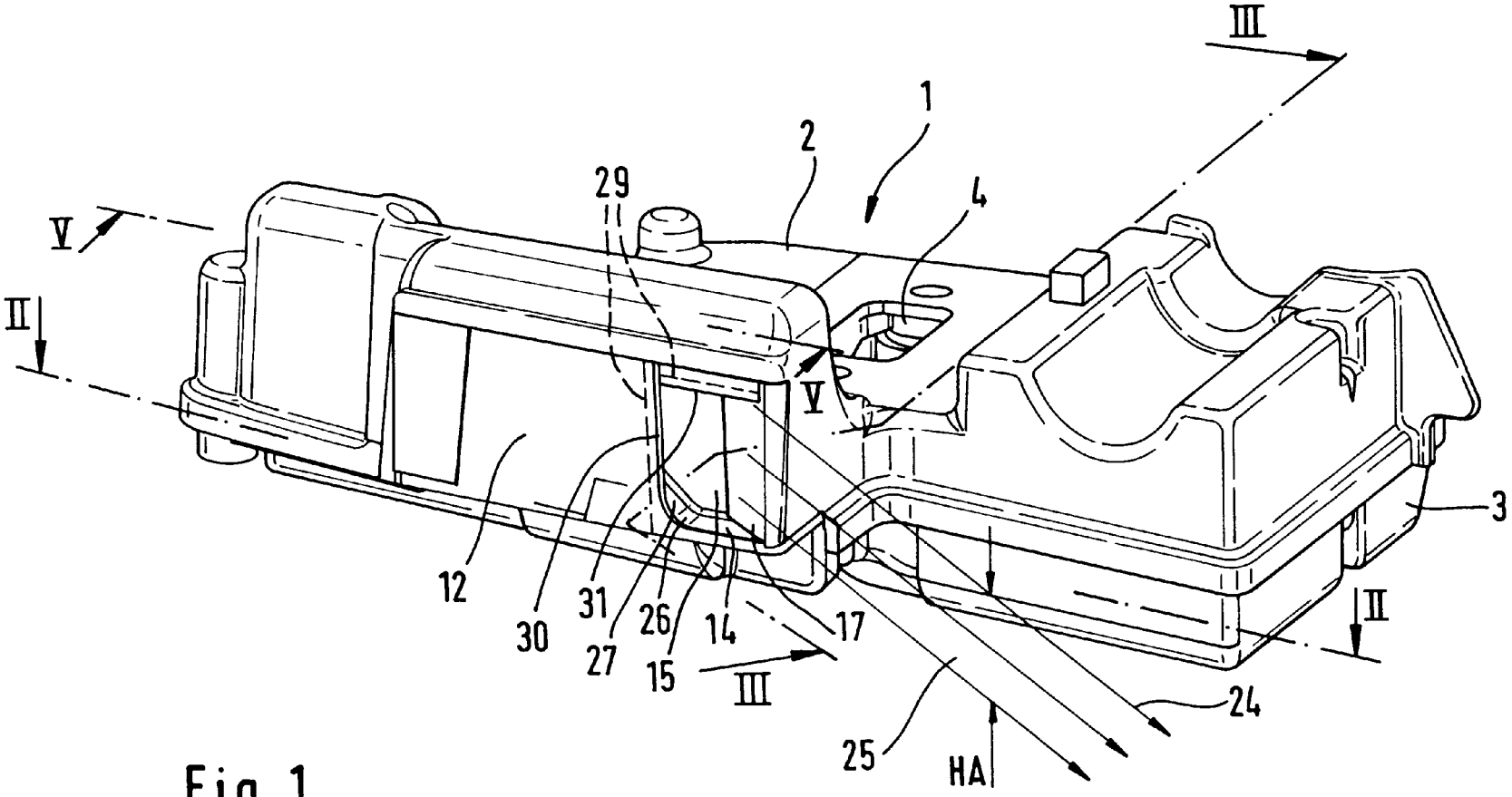
FIG. 1 is a perspective view of an inventive muffler for an internal combustion engine of a portable, hand-guided working tool.

The present invention will now be described in detail with the aid of several specific embodiments utilizing FIGS. 1–5.

The exhaust gas muffler represented in the Figures is designed to be directly connected to the exhaust gas flange of the cylinder of an internal combustion engine which is used in a portable, hand-guided working tool. The exhaust gas muffler is comprised substantially of a housing 1 which is comprised of two housing parts 2 and 3. In the shown embodiment the exhaust gas inlet 4 is arranged in the housing part 2 while the exhaust gas outlet 5 is positioned between the two housing parts 2 and 3, as shown in the sectional view of FIG. 2. As can be seen from FIGS. 3 and 4, the exhaust gas outlet 5 is formed by a cylindrical tube 35 which is divided preferably into two identical halves by the dividing plane 6 of the exhaust gas muffler.

Figure 2:
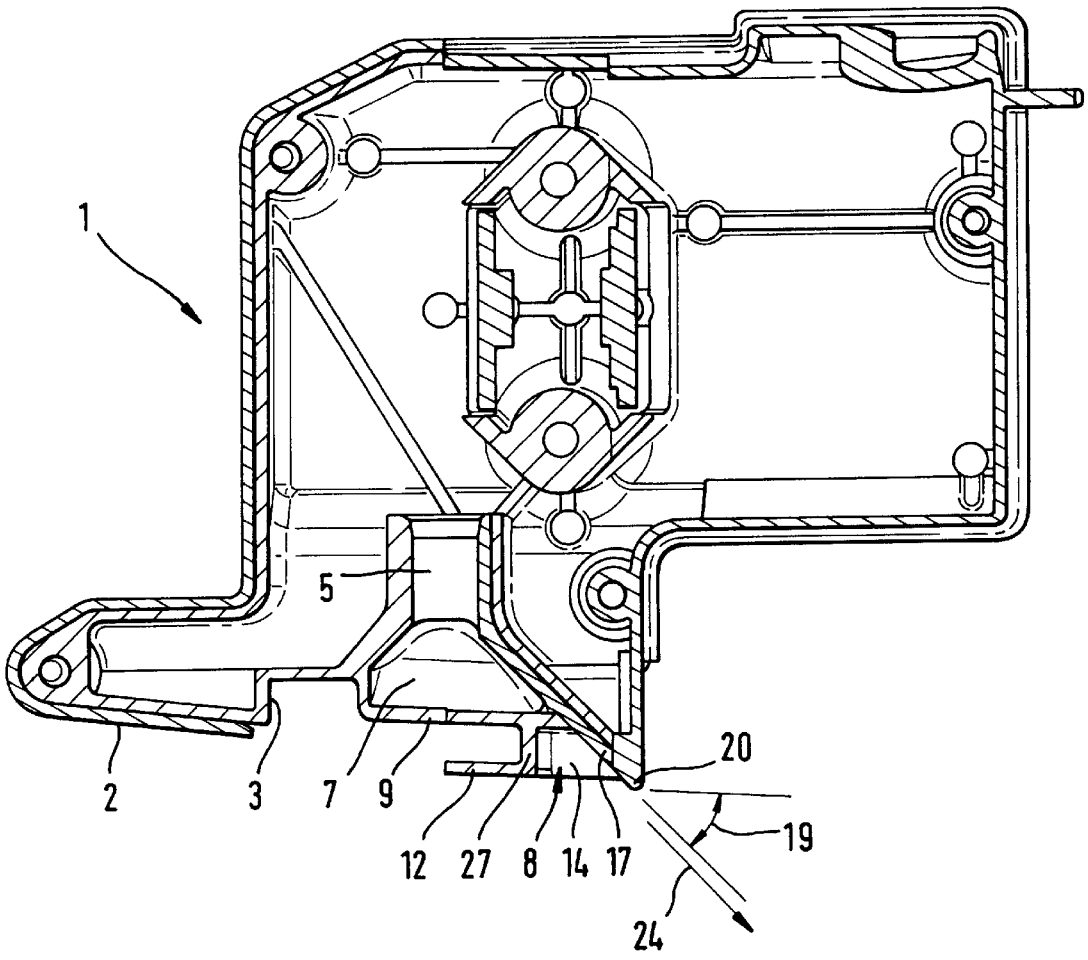
FIG. 2 is a section along the line II—II of FIG. 1.

The exhaust gas outlet 5 opens into an outlet space 7 having arranged downstream thereof an outlet chamber 8 in the flow direction of the exhaust gas. The outlet space 7 widens in the flow direction of the exhaust gas, as can be seen in the representation of FIG. 2. The outlet chamber 8 has a parallelpipedal base shape and widens in the flow direction of the exhaust gas toward the outlet opening 15.

Figure 3:
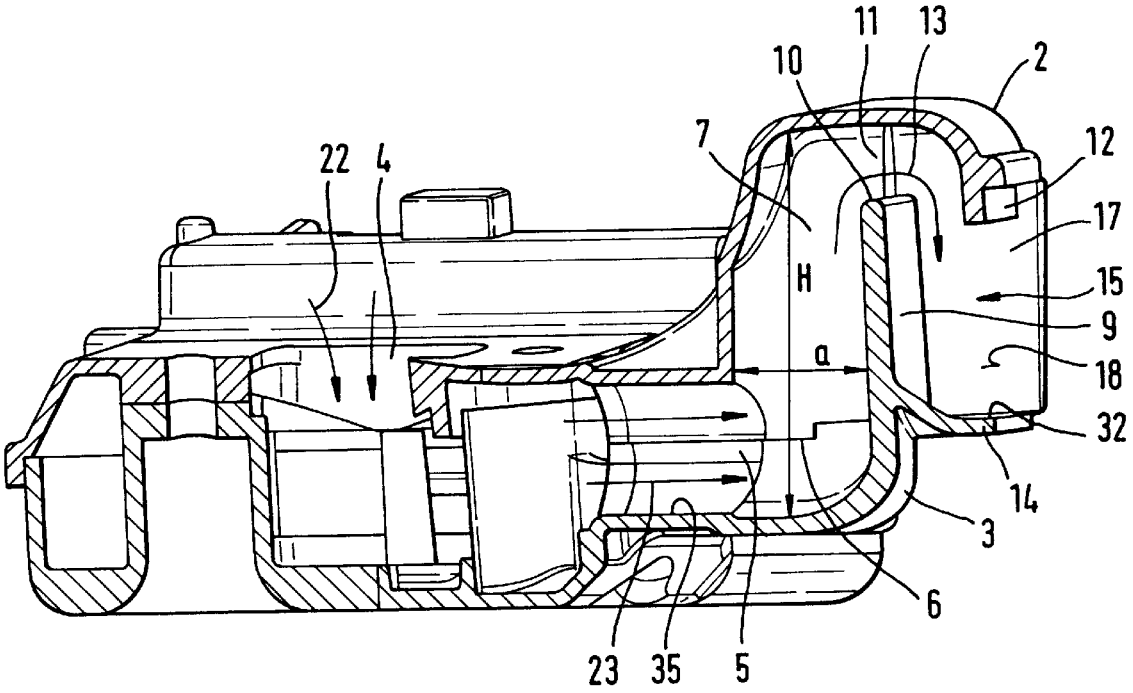
FIG. 3 is a section along the line III—III in FIG. 1.
Figure 4:
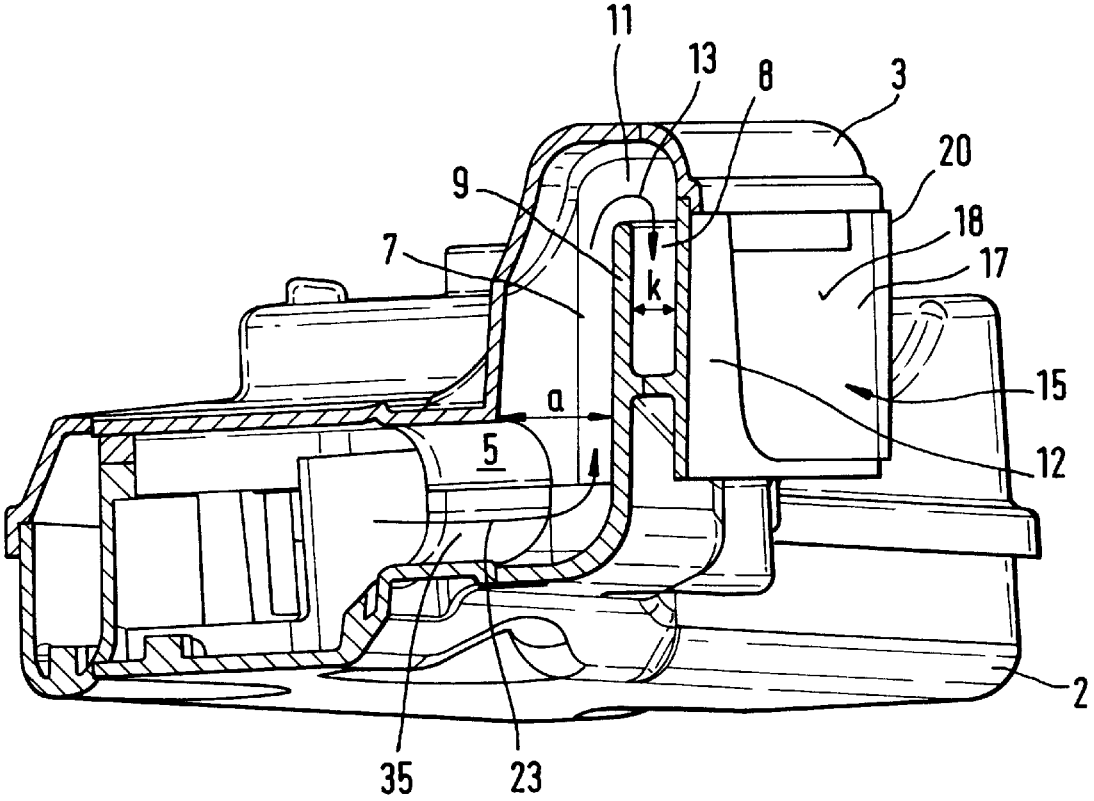
FIG. 4 is a sectional view according to FIG. 3 in a different perspective.
Figure 5:
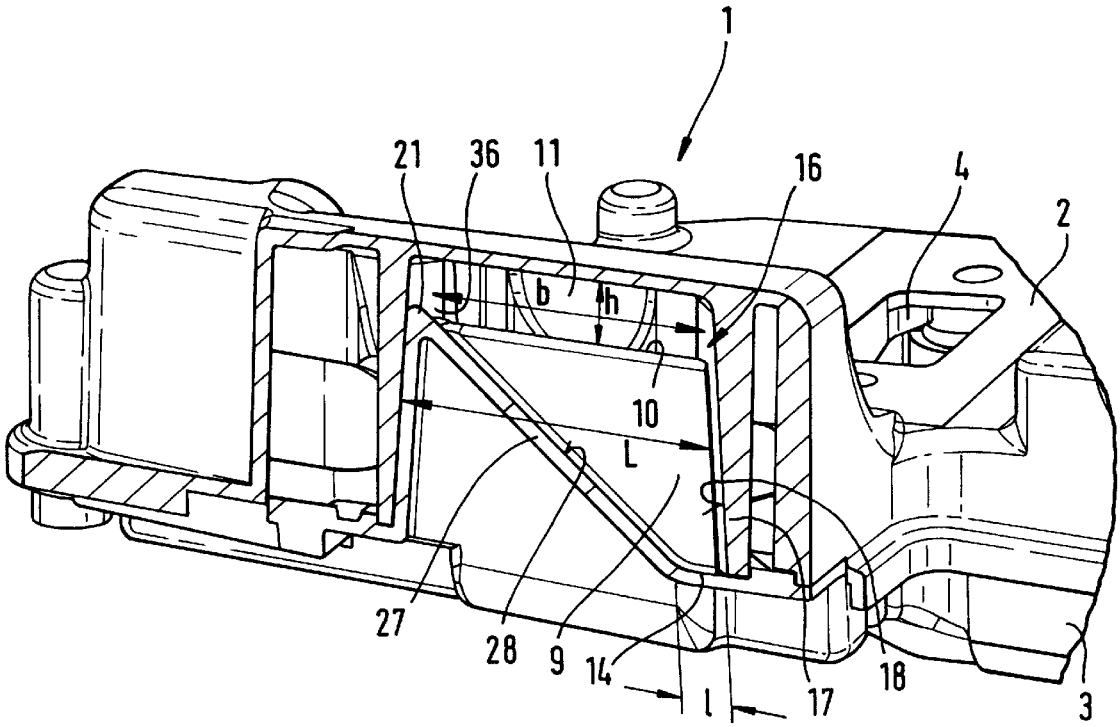
FIG. 5 shows a section along the line V—V of FIG. 1.

From the representations it becomes clear that the outlet space 7 is closed by a rebound wall 9 in the direction toward the outlet chamber 8. Especially FIGS. 3–5 show clearly that the rebound wall 9 is positioned at an axial distance a in front of the cylindrical exhaust gas outlet 5 whereby the longitudinal edge 10 of the rebound wall 9 facing away from the exhaust gas outlet 5 together with the housing of the outlet space 7 delimits a connecting slot 11 which provides a connection between the outlet space 7 and the outlet chamber 8. The connecting slot 11 extends over the entire greatest width b of the outlet space 7 and has a height h which corresponds to approximately 10–30%, preferably 18%, of the height H of the outlet space 7.

As can be seen in FIGS. 1 and 4, an outer wall 12 is arranged parallel to the rebound wall 9 and positioned at a spacing k to the rebound wall 9. The outer wall 12 overlaps the connecting slot 11 in a direction perpendicular to the rebound wall 9 so that exhaust gas flowing across the longitudinal edge 10 through the connecting slot 11 is deflected by 180° and is guided in the direction of arrow 13 to the bottom portion 14 of the outlet chamber 8. A direct exhaust gas exit through the connecting slot 11 to the exterior is thus not possible. In the outer wall 12 an outlet opening 15 is provided which is positioned so as to be adjacent to the end 16 of the connecting slot 11 which is positioned away from the exhaust gas outlet 5. At this end 16 the outlet chamber 8 has a first wall-forming ramp 17 having a ramp surface 18 extending transverse to the connecting slot 11. In the shown embodiment the ramp 17 is formed as an extension of a wall of the outlet space 7, as shown in FIG. 2. The ramp surface 18 is positioned at an angle 19 of approximately 30–70°, preferably 50°, to the rebound wall 9. The ramp surface 18 is positioned substantially perpendicularly to the bottom portion 14 of the outlet chamber 8. The ramp 17 extends from the rebound wall 9 at an upward slant to the outlet opening 15. Preferably, the end 20 of the ramp 17 facing away from the rebound wall 9 projects past the plane of the outer wall 12.

In the outlet chamber 8 a second wall-forming ramp 27 extending substantially perpendicularly to the rebound wall 9 is positioned, as can be seen in FIGS. 2, 4, and 5. The second ramp 27 extends from the rearward end of the connecting slot 11 facing away from the outlet opening 15, at an angle of approximately 45° to a lower portion 14 which extends substantially parallel to the longitudinal edge 10 of the rebound wall 9. The bottom portion 14 has a length I which is approximately 10–30%, preferably 15% of the length L of the rebound wall 9 extending in the longitudinal direction of the connecting slot 11. At the end 21 facing away from the bottom portion 14 the ramp 27 projects with its ramp surface 28 past the longitudinal edge 10 of the connecting slot 11.

The outlet chamber 8 is thus delimited by the rebound wall 9, the wall-forming ramps 17 and 27, the bottom portion 14, and the outer wall 12. The outlet chamber 8 widens, beginning at the end 21 of the second ramp 27, in the direction toward the outlet opening 15.

As can be seen in FIGS. 3 and 4, the exhaust gas flows in the direction of arrow 22 into the exhaust gas inlet whereby the fissured volume of the exhaust gas muffler contributes to the noise reduction (muffling) effect. The fissured volume of the exhaust gas muffler results from the flat, aligned positioning at the non-represented combustion engine and the use of even smallest free spaces.

The exhaust gas leaves in the direction of arrow 23 the exhaust gas muffler through the exhaust gas outlet 5 and enters the widened outlet space 7 from where it flows through the connecting slot 11 in the direction of arrow 13 into the outlet chamber 8. It should be noted that the outflowing exhaust gas is deflected greatly, for example, by the rebound wall 9 and the outer wall 12 covering the connecting slot 11 so that a strong turbulent exhaust gas flow without defined flow direction is produced. Upon entering the outlet chamber 8 the exhaust gas will immediately contact the ramp surface 28 of the ramp 27 so that the exhaust gas passing across the longitudinal edge 10 is deflected in the direction toward the bottom portion 14 of the outlet chamber 8. The ramp 27 projects with its lower end 26 slightly into the opening of the outlet opening 15 whereby, in the longitudinal direction of the ramp 27, the exhaust gas will immediately impact the ramp surface 18 of the first ramp 17 extending transversely to the ramp surface 28 so that the exhaust gas flow will thus experience a slanted directional component (arrow 24) through the outlet opening 15 in the outward direction as shown in FIG. 2.

The exhaust gas passing across the longitudinal edge 10 in the direction of arrow 13 is thus guided, on the one hand, by the ramp surface 28 of the second ramp 27 directly to the exhaust gas outlet opening 15 and, and on the other hand, by the ramp surface 18 of the first ramp 17 in the direction 24 at a slant outwardly away from the exhaust gas muffler. As shown in FIG. 1, an exhaust gas flow 25 of a height HA will exit the exhaust gas muffler in the shown direction indicated by the arrows.

As can be seen in FIG. 1, the outlet opening 15 is delimited, on the one hand, by the bottom portion 14 and the ramp 17 and, on the other hand, by the edges 30 and 31 of the outer wall 12. It may be expedient, to embody the outlet opening such that it is adjustable transverse to the connecting slot 11 as well as longitudinally to the connecting slot 11. For this purpose, the outer wall 12, in the area of the outlet opening 15, has notches 29 as rated break locations which extend longitudinal and/or transversely to the connecting slot 11. By breaking away the edges 30 and 31 the exhaust outlet opening can be adapted to the particular use so that there is no need for different exhaust gas mufflers for a particular application in connection with an internal combustion engine. The adaptation of a universal exhaust gas muffler to the respective desired exhaust gas flow direction 25 is provided by a respective design of the outlet opening.

In order to provide a simple multiple design of the housing parts of the base housing, it is suggested to embody the rebound wall 9, the outer wall 12, and second ramp 27 as a unitary or monolithic part of the lid-like housing part 3 while the outlet space 7 as well as the first ramp 17 are preferably unitary or monolithic parts of the housing part 2 that comprises the exhaust gas inlet 4. In this manner the outlet space 7 as well as the outlet chamber 8 are provided as unitary parts of the housing of the exhaust gas muffler. The separate design of the housing parts allows an individual embodiment for constructive determination of the shape (width, height) as well as the orientation of the exhaust gas flow. It may be expedient to provide the outlet chamber as a separate component instead of a unitary part of the housing whereby this separate component can be shaped and employed according to the desired exhaust gas direction.

The specification incorporates by reference the disclosure of German priority document 298 05 455.8 of Mar. 26, 1998.

The present invention is, of course, in no way restricted to the specific disclosure of the specification and drawings, but also encompasses any modifications within the scope of the appended claims.

What is claimed is:

1. An exhaust gas muffler for an internal combustion engine of a portable, hand-guided working tool, said muffler comprising:

a housing (1) having an exhaust gas inlet (4), an exhaust gas outlet (5), and an outlet space (7), wherein said exhaust gas outlet (5) opens into said outlet space (7);

an outlet opening (15) positioned downstream of said outlet space (7) and having wall elements (12, 17, 27) directing the exhaust gas in an exit flow direction (25);

a rebound wall (9) positioned transverse to said exhaust gas outlet (5) and delimiting said outlet space (7) in a direction toward said outlet opening (15) with the exception of a connecting slot (11) into said outlet opening (15);

wherein said connecting slot (11) is spaced at a distance (k) from an outer wall (12) of said housing (1) extending substantially parallel to said rebound wall (9);

a first ramp (17) extending perpendicularly to said connecting slot (11) and slanted upwardly from said rebound wall (9) to said outlet opening (15);

a second ramp (27) extending in a direction of longitudinal extension of said connecting slot (11) from an end (36) of said insertion slot (11) opposite said first ramp (17) to an edge (32) of said first ramp (17) opposite said connecting slot (11).

2. A muffler according to claim 1, wherein said rebound wall (9), said outer wall (12), and said ramps (17, 27) delimit an outlet chamber (8) positioned between said outlet space (7) and said outlet opening (15).

3. A muffler according to claim 1, wherein said outer wall (12) covers said connecting slot (11).

4. A muffler according to claim 1, wherein said first ramp (17) is positioned at an end of said connecting slot (11) that is adjacent to said outlet opening (15).

5. A muffler according to claim 1, wherein said second ramp (27) begins at the end of said connecting slot (11) facing away from said outlet opening (15).

6. A muffler according to claim 1, wherein said second ramp (27) projects perpendicularly from said rebound wall (9).

7. A muffler according to claim 1, wherein said rebound wall (9) has a longitudinal edge (10) delimiting said connecting slot (11) and wherein said second ramp (27) projects past said longitudinal edge (10).

8. A muffler according to claim 1, wherein said second ramp (27) and said first ramp (17) are connected by a bottom portion (14).

9. A muffler according to claim 8, wherein said bottom portion (14) extends parallel to said connecting slot (11).

10. A muffler according to claim 1, wherein said outlet opening (15) is adjustable in a direction transverse to said connecting slot (11).

11. A muffler according to claim 1, wherein said outlet opening (15) is adjustable in a longitudinal direction of said connecting slot (11).

12. A muffler according to claim 1, wherein said outer wall (12) in the area of said outlet opening (15) has notches (29) as rated break locations, wherein said notches (29) extend parallel to and/or transverse to said connecting slot (11).

13. A muffler according to claim 1, wherein said outlet space (7) is a monolithic part of said housing (1).

14. A muffler according to claim 1, wherein said outlet chamber (8) is a monolithic part of said housing (1).

15. A muffler according to claim 1, wherein said housing (1) is comprised of a first housing part (2) and a second housing part (3), wherein said rebound wall (9), said outer wall (12) and said second ramp (27) are monolithic parts of said second housing part (3) forming a lid of said housing (1), and wherein said outlet space (7) and said first ramp (17) are monolithic parts of said first housing part (2) comprising said exhaust gas inlet (4).

* * * * *